US006416589B1

(12) United States Patent
Lipkin et al.

(10) Patent No.: US 6,416,589 B1
(45) Date of Patent: Jul. 9, 2002

(54) CARBON-ENHANCED FLUORIDE ION CLEANING

(75) Inventors: Don Mark Lipkin, Niskayuna, NY (US); Lyle Timothy Rasch, Fairfield, OH (US); Peter Joel Meschter, Niskayuna, NY (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 09/251,061

(22) Filed: Feb. 18, 1999

(51) Int. Cl.[7] ..... B08B 5/00

(52) U.S. Cl. ..... 134/19; 134/2; 134/3; 134/30; 134/31; 134/39; 134/41; 134/42; 228/119; 228/206

(58) Field of Search ..... 134/2, 19, 31, 134/39, 3, 30, 41, 42; 228/119, 206

(56) References Cited

U.S. PATENT DOCUMENTS

| | | | | |
|---|---|---|---|---|
| 3,713,206 A | | 1/1973 | Galmiche | 29/294 |
| 4,098,450 A | | 7/1978 | Keller et al. | 228/119 |
| 4,188,237 A | | 2/1980 | Chasteen | 134/2 |
| 4,324,594 A | | 4/1982 | Chasteen | 134/2 |
| 4,328,044 A | | 5/1982 | Chasteen | 134/2 |
| 4,405,379 A | | 9/1983 | Chasteen | 134/2 |
| 4,525,250 A | | 6/1985 | Fahrmbacher-Lutz et al. | 204/58.5 |
| 4,698,130 A | * | 10/1987 | Restall et al. | 156/646 |
| 4,889,589 A | | 12/1989 | McComas | 156/646 |
| 5,071,486 A | | 12/1991 | Chasteen | 134/2 |
| 5,373,986 A | * | 12/1994 | Rafferty et al. | 228/206 |
| 5,614,054 A | | 3/1997 | Reeves et al. | 156/344 |
| 5,728,227 A | | 3/1998 | Reverman | 134/2 |
| 5,898,994 A | * | 5/1999 | Miller et al. | 29/889.1 |

FOREIGN PATENT DOCUMENTS

| | | | |
|---|---|---|---|
| EP | 0034041 | * | 8/1981 |
| EP | 023715 3 | * | 9/1987 |
| WO | WO00/48751 | * | 8/2000 |

OTHER PUBLICATIONS

Miglietti, W Et Al "Advantages of Fluoride Ion Cleaning at Sub–atmospheric Pressure", Eng. Failure Anal. 5(2) 149–169, 1998.*

Alfred L. Clavel and Jon A. Kasperan, *Vapor–Phase, Fluoride–Ion Processing of Jet Engine Superalloy Components*, Plating & Surface Finishing, pp. 52–58.

Alfred L. Clevel, Jos. A. Kasperin, *Vapor Phase Fluoride Ion Processing of Aeroenging Superalloy Components*, pp. 1005–1010.

Anton G. Stroom, Tom Smith, Stijn Pietersen, *Fluorocarbon Cleaning Process: The Ultimate Cleaning Pretreatment for Superalloy Repair*, Dayton Process, Technical Update, pp. 107.

* cited by examiner

*Primary Examiner*—Sharidan Carrillo
(74) *Attorney, Agent, or Firm*—Robert P. Santandrea; Noreen C. Johnson

(57) ABSTRACT

A method and system for cleaning a metal article. The system is used to employ a method that comprises placing the article in a means defining a chamber; subjecting the article to a gaseous atmosphere in the means defining a chamber, where the gaseous atmosphere consisting essentially of carbon, hydrogen, and fluorine; and subjecting the article to the gaseous atmosphere at a temperature in a range from about 815° C. to about 1100° C. to clean the article.

15 Claims, 1 Drawing Sheet

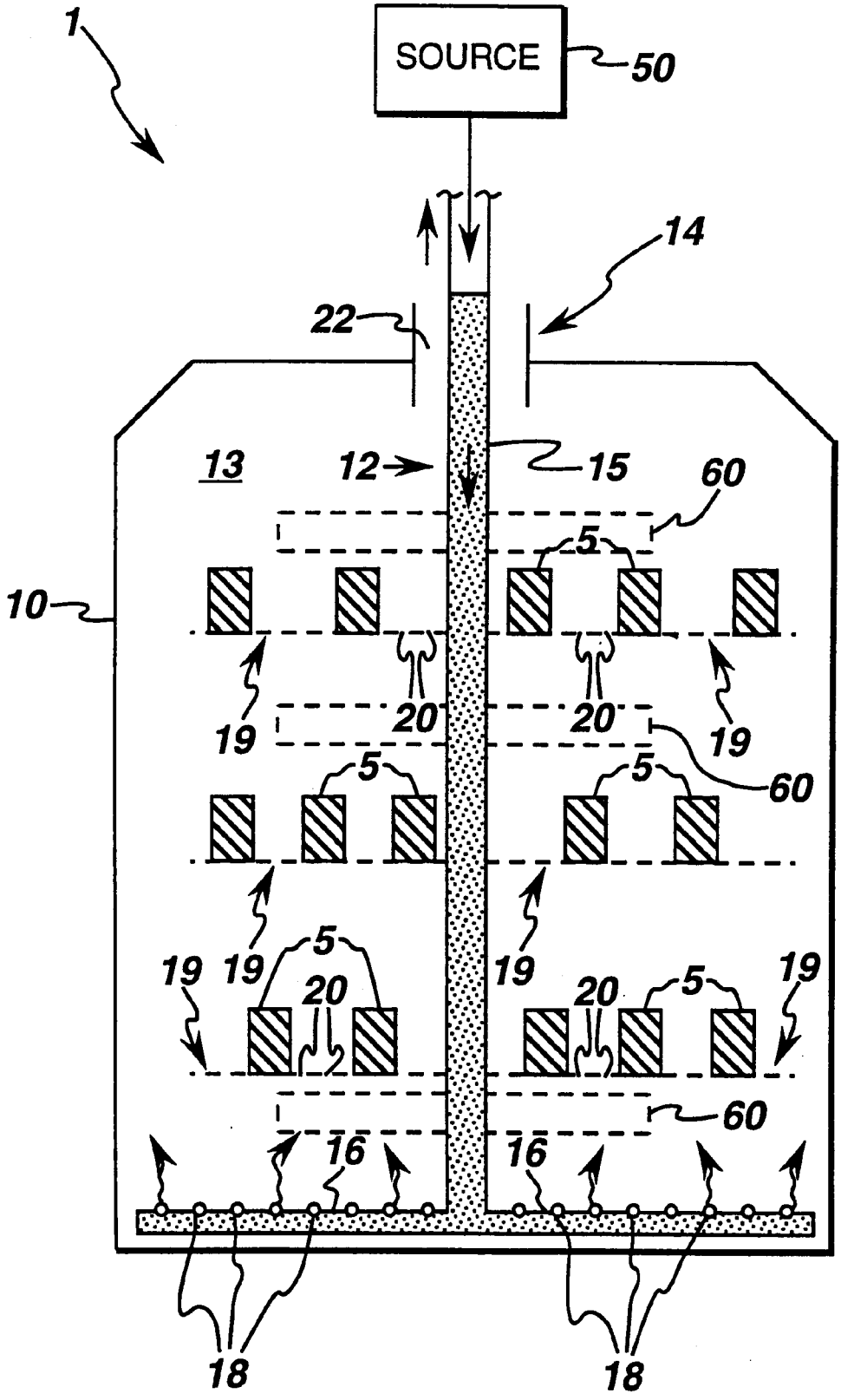
1
SOURCE
50
14
22
13
12
15
60
5
10
19
20
20
19
60
5
5
19
19
5
19
20
20
5
19
60
16
16
18
18

CARBON-ENHANCED FLUORIDE ION CLEANING

BACKGROUND OF THE INVENTION

The invention relates to cleaning processes and systems. In particular, the invention relates to fluoride ion cleaning.

Aeronautical and power generation turbine components, such as blades, shrouds, and vanes, are often formed from superalloy materials, including but not limited to, nickel-, cobalt-, and iron-nickel-based superalloy materials. During service, turbine components are exposed to high pressure and high temperature environments and may form complex, chemically stable, thermal oxides. These oxides comprise, but are not limited to, oxides of aluminum, titanium, chromium, and combinations thereof.

Turbines are periodically overhauled in order to prolong life or enhance performance. During these overhauls, the turbine components may be subjected to various repair operations, including welding or brazing. The presence of chemically stable thermal oxides reduces the ability of a superalloy to be welded or brazed. Therefore, removal of these oxides by cleaning the turbine components prior to repair is important for successful turbine overhaul.

When only superficial repairs are required, grit-blasting or grinding can effectively remove surface oxides, although, these cleaning operations can result in inadvertent and undesirable loss of the base alloy, compromising turbine efficiency and reliability. To avoid outright excavation of the affected areas, repair of hard-to-reach surfaces, including internal passages and highly concave sections, such as cooling holes, cracks, and slots, generally requires a cleaning process that minimally degrades or damages the base alloy.

Batch thermo-chemical cleaning processes have been proposed for cleaning turbine components. Batch thermo-chemical cleaning processes attempt to remove oxides from crevices and hard-to-reach surfaces, while leaving the base alloy intact. The chemically stable oxides are generally resistant to conventional cleaning processes, such as, but not limited to, vacuum- and hydrogen-reduction or acid- and caustic- etching.

Several high-temperature, reactive-atmosphere batch cleaning processes have been proposed to affect cleaning of chemically stable oxides from turbine components. These processes generally rely on the high reactivity of fluoride ions. Processes that use fluoride ions for cleaning are collectively known as "fluoride ion cleaning" (FIC) processes.

Variants of the FIC process include a "mixed-gas process," that employs a hydrofluoric (HF)/hydrogen ($H_2$) gas mixture; a "chromium fluoride decomposition process," that employs solid chromium fluoride and hydrogen gas for cleaning; and a "fluorocarbon decomposition process," that employs polytetrafluoroethylene (PTFE) and hydrogen gas for cleaning. FIC processes are conducted at elevated temperatures, where solid (s) metal oxide (MO) is converted to vapor-phase (v) metal fluoride (MF) following a reaction having the general form:

$$2HF_{(v)}+MO_{(s)}\rightarrow H_2O_{(v)}+MF_{(v)} \quad (1)$$

Differences between the various FIC processes include the fluoride ion source, reaction temperature, and reaction control mechanisms, and the composition of reaction byproducts. These differences, in turn, define a cleaning capability of each cleaning process. Both the fluorocarbon decomposition and chromium fluoride decomposition processes rely on finite sources of fluoride (PTFE or chromium fluoride, respectively). Prolonged process cycles can exhaust the fluoride source, causing the cleaning reaction to stop prematurely. The conventional mixed-gas FIC process uses an external, gaseous HF source and provides continuous control of fluoride activity through adjustment of the HF-$H_2$ ratio Accordingly, a need for an enhanced FIC process for cleaning articles exists.

SUMMARY OF THE INVENTION

A cleaning method and system are provided for in the invention. The method comprises placing the article in a chamber, subjecting the article to a gaseous atmosphere consisting essentially of carbon, hydrogen, and fluorine; and heating the article to a temperature in a range greater than about 1500° F. (815° C.) to about 2000° F. (1100° C.) to affect cleaning of the article.

The invention also sets forth a system for cleaning articles. The system comprises means for defining a chamber; means for subjecting the article to a gaseous atmosphere, the gaseous atmosphere consisting essentially of carbon, hydrogen, and fluorine; and means for subjecting the article to the gaseous atmosphere at a temperature in a range greater than about 1500° F. (815 ° C.) to about 2000° F. (1 100° C.) to clean the article.

These and other aspects, advantages and salient features of the invention will become apparent from the following detailed description, which, when taken in conjunction with the annexed drawings, where like parts are designated by like reference characters throughout the drawings, disclose embodiments of the invention.

BRIEF DESCRIPTION OF THE DRAWINGS

FIG. 1 is a cross-sectional view of a fluoride ion cleaning system, as embodied by the invention.

DETAILED DESCRIPTION OF THE DRAWING

A fluoride ion cleaning (FIC) process, as embodied by the invention, comprises a carbon-enhanced, mixed-gas FIC process (hereinafter referred to as "c-FIC"), which removes oxides from surfaces and cracks of articles. The c-FIC process can. be used to clean metal articles, such as but not limited to superalloy aeronautical and power generation turbine vanes, shrouds, blades, and like elements (hereinafter "turbine components").

A finite carbon activity in the c-FIC process, as embodied by the invention, is established by adding a carbon-containing constituent to the cleaning atmosphere. The carbon-containing constituent comprises at least one of a gaseous carbon-containing constituent and a solid carbon-containing constituent. The fluoride ions for the c-FIC process are generated by a mixed-gas atmosphere that comprises hydrogen fluoride (HF) gas. The c-FIC process, as embodied by the invention, increases the efficiency and quality of turbine component cleaning with respect to known FIC processes by enhancing oxide removal, and especially by enhancing oxide removal from highly concave surfaces, such as cracks.

A c-FIC system and process, as embodied by the invention, will be described. The c-FIC process is conducted at an elevated temperature and follows a reaction having the general form as in Equation (2):

$$C+MO_{(s)}+HF_{(v)}\rightarrow CO_{(v)}+MF_{(v)}+\tfrac{1}{2}H_{2(v)} \quad (2)$$

The c-FIC process temperature is in a range between about 1500° F. (815 ° C.) and about 2000° F. (1100° C.). For example, the FIC process reaction temperature is in a range between about 1800° F. (980° C.) and about 1900° F. (1040° C.). Further, the temperature during the c-FIC process can vary. Alternatively, the temperature during the c-FIC process can remain constant.

The fluoride source for the c-FIC process originates from hydrogen fluoride (HF) gas, similar to conventional mixed-gas FIC processes. Further, a carbon-containing gas constituent, generalized as $C_aH_b$, where a and b are 1, 2, 3, . . . , is added to the HF (and $H_2$) gas mixture, as described below, to create a finite carbon activity in the c-FIC process. The gases that enter the c-FIC process are referred to hereinafter as c-FIC process gases, and gases that are liberated in the c-FIC process are referred to as c-FIC reaction products. Accordingly, the c-FIC process atmosphere can be generalized as $\Sigma n_i C_x H_y F_z$, where $n_i$ determines the relative concentration of each of the i process gas components, i is an integer, and the values of x, y, and z are greater than 0.

An exemplary c-FIC system 1 is schematically illustrated in FIG. 1; however, other c-FIC system constructions are within the scope of the invention. The structure set forth in FIG. 1 is not meant to limit the invention in any way. The c-FIC system comprises a retort 10 (also known as a "reaction chamber"). The retort 10 comprises materials that are compatible with the c-FIC cleaning atmosphere. For example, the retort 10 may comprise nickel-, iron-, or cobalt-based alloys. A gas inlet pipe and support rack assembly 12 extends through opening 14 in the retort 10, and is disposed in the interior 13 of the retort 10.

The gas inlet and rack assembly 12 comprise a main inlet conduit 15, which permits c-FIC process gases to enter the retort 10. Opening 14 also comprises an exhaust vent 22, which permits the c-FIC reaction products to escape from the interior 13 of the retort 10. The main conduit inlet 15 extends from a c-FIC process gas source 50, such as, for example, one or more compressed gas tank that leads to at least one manifold 16. The manifold 16 includes apertures 18, from which the c-FIC process gases enter the retort 10. The gas inlet and rack assembly 12 further comprises racks 19 that support articles to be cleaned, such as turbine components 5. The racks 19 can comprise a plurality of perforations or openings 20 that allow the c-FIC process gases to pass through the racks 19, and past the turbine components 5.

One exemplary c-FIC process, as embodied by the invention, will now be described. This process is not meant to limit the invention in any way. An elevated temperature c-FIC atmosphere is initially established in the retort 10. The c-FIC atmosphere has the effect of reducing or converting the oxides located in hard-to-reach surfaces, such as but not limited to cracks, of a turbine component 5 to volatile fluorides.

The oxide removal by the c-FIC process, as embodied by the invention, is enhanced with respect to conventional mixed-gas FIC processes, by creating and controlling carbon activity. A finite carbon activity is established by adding a carbon-containing constituent to the process gases. For example,. a gaseous, carbon-containing species can be introduced into a mixed-gas (HF-$H_2$) FIC process. The carbon-containing species comprise a gas, such as, but not limited to, propene, ($C_3H_6$), propane ($C_3H_8$), methane ($CH_4$), ethylene ($C_2H_4$), acetylene ($C_2H_2$),. and other gases that are classified by $C_aH_b$, where a and b are 1, 2, 3, . . . , freon ($CF_4$), and combinations thereof. As discussed above, the c-FIC atmosphere is comprised of $\Sigma n_i C_x H_y F_z$, where i is an integer, and x, y, and z are greater than 0. For example, and in no way limiting the invention, if x=0 and y=z, the process atmosphere comprises only HF. If x=z=0, the process atmosphere comprises only $H_2$. If y=z=0, the process atmosphere comprises only C. If, (y/x)=4 and z=0, the process atmosphere comprises only $CH_4$. If (z/x)=4 and y=0, the process atmosphere comprises only $CF_4$. In general, the process atmosphere comprises a combination of any number of these components. Accordingly, exemplary gas compositions for the c-FIC process, as embodied by the invention, comprise, but are not limited to, $CH_4$; $CH_4$+HF; $H_2$+$CH_4$+HF; $H_2$+$CF_4$; $H_2$+$CF_4$+MF, and combinations thereof.

Alternatively, the carbon-containing constituent, as embodied by the invention, comprises a solid carbon source 60 disposed in the retort 10. The carbon source 60 comprises a material, such as, but not limited to, graphite ($C_{(gr)}$), any of a number of metal carbides (MC), and combinations thereof. For example, graphite can comprise, but is not limited to, graphite felt, graphite powder, graphite plates, graphite racks, graphite spacers, and any other retort components and combinations thereof. The solid carbon source 60 is disposed anywhere in the retort 10. The solid carbon source can be used in conjunction with a gaseous carbon source. The illustrated locations of the solid, carbon source in FIG. 1 are merely exemplary and are not meant to limit the invention in any way.

An exemplary c-FIC process, as embodied by the invention, using graphite felt as the carbon-containing constituent, will now be discussed. This c-FIC process is merely exemplary and is not intended to limit the invention in any way. This c-FIC process is demonstrated on aluminum oxide ($Al_2O_3$) samples. Since aluminum oxide is a common oxide on advanced turbine components and is believed to be the cleaning-rate limiting oxide in alumina-forming superalloys, measuring aluminum oxide weight loss provides an indication of the effectiveness of the c-FIC process.

The graphite felt was disposed in the retort 10 and the temperature in the retort is provided at about 1800° F. An HF/$H_2$ gas mixture consisting of about 13% HF entered the retort, passing through the graphite felt prior to reaching the oxide articles. The aluminum oxide samples were "cleaned" according to the reaction of Equation (2). No sooting was observed and the aluminum oxide samples subjected to this c-FIC process, as embodied by the invention, exhibited as much as a 75% increase in weight loss compared to aluminum oxide samples run under nominally identical mixed-gas FIC process conditions, but without graphite felt.

Thermodynamic calculations were conducted to assess the effect of a carbon-containing constituent, such as, but not limited to, methane and graphite, on the efficiency of mixed-gas FIC processes. The thermodynamic calculations were conducted on aluminum oxide, for the reasons discussed above. The results of the thermodynamic calculations confirm that carbon raises the equilibrium vapor pressure of aluminum fluoride ($AlF_3$), which is the volatile species associated with aluminum oxide removal in the FIC process.

For example, and in no way limiting the invention, when methane ($CH_4$) is added to a mixed-gas (HF-$H_2$) FIC atmosphere in a ratio of 1% $CH_4$-13% HF-86% $H_2$ at a temperature of about 1800° F. (980° C.), a carbon activity of about 0.06 results, preventing sooting while providing an aluminum fluoride equilibrium vapor pressure that is greater than twice that resulting from a conventional mixed-gas (87% HF-13% $H_2$) FIC process. This enhanced vapor pressure was accompanied by a precipitous reduction in equilibrium water vapor pressure and a corresponding increase in the carbon monoxide (CO) vapor pressure. Similar results for methane greater amounts, such as about 6% and about 18% (of the total gaseous environment), are achieved. Further, similar results with 100% methane are possible.

Thus, according to the present invention, the gaseous environment may include hydrogen fluoride (HF), hydrogen ($H_2$), and at least one of $C_xH_y$ and $C_xF$ in the following volume percent ranges: hydrogen fluoride (HF) up to about 25%, hydrogen ($H_2$) up to about 100%, and $\Sigma n_i C_x H_y F_z$, in a range from about 0.01% to about 100%, where i is an integer and x, y, and z are greater than 0. Also, the step of subjecting the article to the gaseous atmosphere may include subjecting the article to the gaseous atmosphere at a temperature about or greater than about 1000° C., as can be best understood from Table 1, below.

Thermodynamic calculations were also conducted to assess the effect of a solid, carbon-containing constituent, such as, but not limited to, graphite, on FIC efficiency. The thermodynamic calculations were conducted on aluminum oxide, for the reasons discussed above. The results of the thermodynamic calculations, as summarized in Table 1, confirm that the presence of carbon raises the aluminum fluoride ($AlF_3$) equilibrium vapor pressure, which is the major species involved in aluminum oxide removal in the FIC process. The increase in aluminum fluoride vapor pressure in the presence of carbon is accompanied by an increase in the vapor pressure of ($H_2O$+CO), indicating a more efficient removal of oxygen from the oxide system, which of course is advantageous in article cleaning.

TABLE 1

Effect of Graphite ($C_{gr}$) on the FIC of $Al_2O_3$

| T (° F./° C.) | Graphite | $P_{AlF3}$ (atm) | $p_{H2O}$ (atm) | $p_{co}$ (atm) | % HF used |
|---|---|---|---|---|---|
| 1600 | No | 4.00E-04 | 8.40E-03 | 0 | 0.9 |
| (870) | Yes | 4.00E-04 | 1.75E-03 | 3.84E-02 | 0.9 |
| 1800 | No | 2.72E-03 | 4.21E-03 | 0 | 6.5 |
| (980) | Yes | 5.50E-03 | 4.96E-04 | 3.83E-02 | 13.4 |
| 2000 | No | 3.39E-03 | 5.14E-03 | 0 | 7.9 |
| (1090) | Yes | 2.59E-02 | 1.83E-04 | 4.11E-02 | 64.9 |

While various embodiments are described herein, it will be appreciated from the specification that various combinations of elements, variations or improvements therein may be made by those skilled in the art, and are within the scope of the invention.

We claim:

1. A method for cleaning oxides from a metal article formed from a superalloy material, the method comprising:

placing said metal article in a chamber;

subjecting said metal to a gaseous atmosphere in said chamber, said gaseous atmosphere consisting essentially of compounds of carbon, hydrogen, and fluorine;

disposing a solid carbon-containing constituent comprising metal carbides (MC) and at least one gaseous carbon-containing constituent directly in said chamber to provide a source of said carbon compound in said chamber, and subjecting said metal article to said gaseous atmosphere at a temperature greater than about 815° C. for a predetermined period of time to remove said oxide from said metal article, thereby cleaning said metal article.

2. A method according to claim 1, wherein said hydrogen and fluorine of said gaseous atmosphere include at least one of gaseous hydrogen ($H_2$) and gaseous hydrogen fluoride (HF).

3. A method according to claim 1, wherein said gaseous atmosphere includes:

a. gaseous hydrogen fluoride HF), and b. said solid metal carbides (MC) and said at least one gaseous carbon-containing constituent selected from the group consisting of methane ($CH_4$), acetylene ($C_2H_2$), freon ($CF_4$), and combinations thereof, and c. gaseous hydrogen ($H_2$).

4. A method according to claim 1, wherein said gaseous carbon-containing constituent comprises $C_xH_y$, where x and y are greater than 0.

5. A method according to claim 1, wherein said gaseous carbon-containing constituent comprises $C_xF_z$ where x and z are greater than 0.

6. A method according to claim 1, wherein said gaseous carbon-containing constituent comprises $C_xH_yF_z$, where x, y, and z are greater than 0.

7. A method according to claim 1, wherein the step of disposing said solid carbon-containing constituent in said chamber further comprises disposing graphite in said chamber.

8. A method according to claim 1, wherein said cleaning comprises removing oxides from said metal article by the reaction:

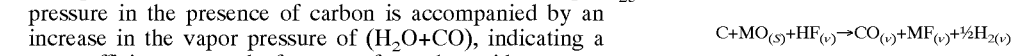

$$C+MO_{(S)}+HF_{(v)} \rightarrow CO_{(v)}+MF_{(v)}+\tfrac{1}{2}H_{2(v)}$$

where the metal oxide (MO) is a solid (s), and said gaseous atmosphere consisting essentially of compounds of carbon, hydrogen, and fluorine includes gaseous hydrogen $H_2$, gaseous hydrogen fluoride (HF), gaseous carbon monoxide (CO), and gaseous metal fluoride (MF) and said carbon (C) is provided by said solid metal carbides (MC) and said at least one gaseous carbon-containing constituent.

9. A method according to claim 1, wherein said cleaning of said metal article comprises removing said oxides from cracks and crevices on a surface of said metal article.

10. A method according to claim 1, wherein the step of subjecting said metal article to said gaseous atmosphere comprises subjecting said metal article to said gaseous atmosphere at a temperature up to about 1100° C.

11. A method according to claim 1, wherein the step of subjecting said metal article to said gaseous atmosphere comprises subjecting said metal article to said gaseous atmosphere at a temperature up to about 1000° C.

12. A method according to claim 1, wherein the step of subjecting said metal article to said gaseous atmosphere comprises subjecting said metal article to said gaseous atmosphere at a temperature in a range between about 815° C. and about 1100° C.

13. A method according to claim 1, wherein said metal article comprises a turbine component.

14. A method according to claim 6, wherein said gaseous atmosphere comprises gaseous hydrogen fluoride (HF), gaseous hydrogen ($H_2$), and at least one of gaseous $C_xH_y$ and gaseous $C_xF_z$ in the following volume percent ranges: gaseous hydrogen fluoride (HF) up to about 25%, gaseous hydrogen ($H_2$) up to about 100%, and $\Sigma n_i C_x H_y F_z$, in a range from about 0.01% to about 100%, where i is an integer and x, y, and z are greater than 0.

15. A method according to claim 7, wherein said graphite comprises at least one of graphite felt, graphite plates, graphite powder, graphite tooling, and combinations thereof disposed in said chamber.

* * * * *